United States Patent [19]

Farrow et al.

[11] 4,116,124

[45] Sep. 26, 1978

[54] TWO-SIDED SIMULTANEOUS PRINTING METHOD

[75] Inventors: Harold Frederick Farrow, Hitchin; Bernard Booth Rackstraw, High Wycombe, both of England

[73] Assignee: Encoline (Process) Limited, England

[21] Appl. No.: 835,585

[22] Filed: Sep. 22, 1977

Related U.S. Application Data

[63] Continuation of Ser. No. 682,184, Apr. 30, 1976, abandoned, which is a continuation of Ser. No. 548,558, Feb. 10, 1975, abandoned.

[30] Foreign Application Priority Data

Feb. 20, 1974 [GB] United Kingdom ..... 7816/74

[51] Int. Cl.[2] ..... B41M 1/10; B41F 1/20

[52] U.S. Cl. ..... 101/170; 101/163; 101/296

[58] Field of Search ..... 101/170, 163, 289, 296; 264/273, 279, 328; 425/116, 120, 121, 123, 124, 125, 130, 242 R; 427/208, 209, 282, 272

[56] References Cited

U.S. PATENT DOCUMENTS

| | | | |
|---|---|---|---|
| 2,032,028 | 2/1936 | Rees | 425/811 X |
| 2,298,365 | 10/1942 | Gits et al. | 264/328 X |
| 2,302,342 | 11/1942 | Nast | 428/443 X |
| 2,382,200 | 8/1945 | Brunner | 425/125 X |
| 2,415,961 | 2/1947 | Nast | 264/328 X |
| 2,457,440 | 12/1948 | Booth | 264/328 X |
| 2,485,323 | 10/1949 | Schwartz | 264/328 X |
| 2,591,941 | 4/1952 | Innerfield | 101/426 X |
| 2,656,570 | 10/1953 | Harmon et al. | 425/811 X |
| 2,766,484 | 10/1956 | Sanderson | 425/811 X |
| 3,443,281 | 5/1969 | Walby | 425/812 |
| 3,444,618 | 5/1969 | Sorlie | 425/116 X |

*Primary Examiner*—J. Reed Fisher

[57] ABSTRACT

Intaglio printing plate apparatus comprising in combination two intaglio die plates one for attachment to the top platen of a printing press and one for attachment to the lower or bottom platen with the recessed intaglio designs of the two plates, facing each other, that one of the plates which is to be attached to the top platen being formed with passages passing through its thickness to the recessed intaglio design, the other plate being formed with air bleed holes leading from the recessed design to atmosphere.

5 Claims, 4 Drawing Figures

TWO-SIDED SIMULTANEOUS PRINTING METHOD

This is a continuation of Ser. No. 682,184 filed Apr. 30, 1976, now abandoned, which in turn is a continuation of Ser. No. 548,558 filed Feb. 10, 1975, now abandoned.

This invention relates to intaglio printing plates and in particular but not exclusively to plates of the type in which the material to be printed is injected through passages passing through the plate to a recessed or intaglio design on the printing surface of the plate.

If the material is in the form of sheets to be printed on both faces it has hitherto been necessary firstly to print on one side and then to reverse the sheet and print the other as a separate operation.

The general object of this invention is to enable a sheet to be printed on both faces simultaneously in a single printing operation.

This is achieved by intaglio printing plate apparatus in accordance with the invention which comprises in combination two intaglio die plates attached to the top and bottom press platens of the apparatus, respectively. Preferably one of the plates is formed with passages passing through it for injection of printing material to the recess and the other with air bleed holes leading from the recessed design to atmosphere through an appropriate manifold member. The sheet material to be printed is then formed with holes of appropriate size and position to enable the material to be printed to flow from the recess in one plate through the holes in the sheet to fill the intaglio recess in the other plate. The sheet may thus be printed on both sides simultaneously in one stroke of the printing press, the printed material filling the feed holes in the sheet.

Preferably the recessed design in one plate is a mirror image of that in the other plate.

The material to be printed may be injected or forced through either the top or bottom printing plate using injector or pump units and if desired a number of differing materials and colours may be printed simultaneously. As the air in the recessed designs in the top and bottom plates has to be removed it is convenient for the plate opposite to that attached to the injector units to be provided with air bleed holes preferably controlled by a manifold member so that air can bleed out through the plate but cannot be sucked back into the recessed design.

The holes in the sheet material to be printed may be positioned as required for effective performance. These are best located at least at points of change of direction of the design to be printed where there is maximum resistance to flow.

The holes should be big enough to allow flow therethrough of the material to be printed when this material is under pressure but small enough to prevent material flowing through the holes under gravity when for example the printing operation is finished and the sheet material is lifted from the lower plate. As an example the feed holes may be from 10–30 thousands of an inch in diameter.

The manifold member may comprise a plate to be secured to the "bottom" printing plate and formed with passages to communicate with the air bleed holes in the "bottom" plate. The holes in the bottom plate are preferably relatively small e.g. from 0.040 inch to 0.005 inch in diameter (preferably 0.020 inch) and provide flow restriction and in this case the passages in the manifold member will have a sufficiently large cross-section to allow flow of printed fluid and entrapped air. Alternatively a non-return valve means may be provided.

Apparatus in accordance with the invention has been found to be particularly useful for printing sealant material onto the top and bottom faces of gaskets. Use of the apparatus for this purpose halves the time and cost of depositing coatings on double-sided gaskets and avoids the necessity of having to cure the gasket twice (to set the sealant or coating material).

The invention will now be further described by way of example with reference to the accompanying drawings in which.

Figure 1:
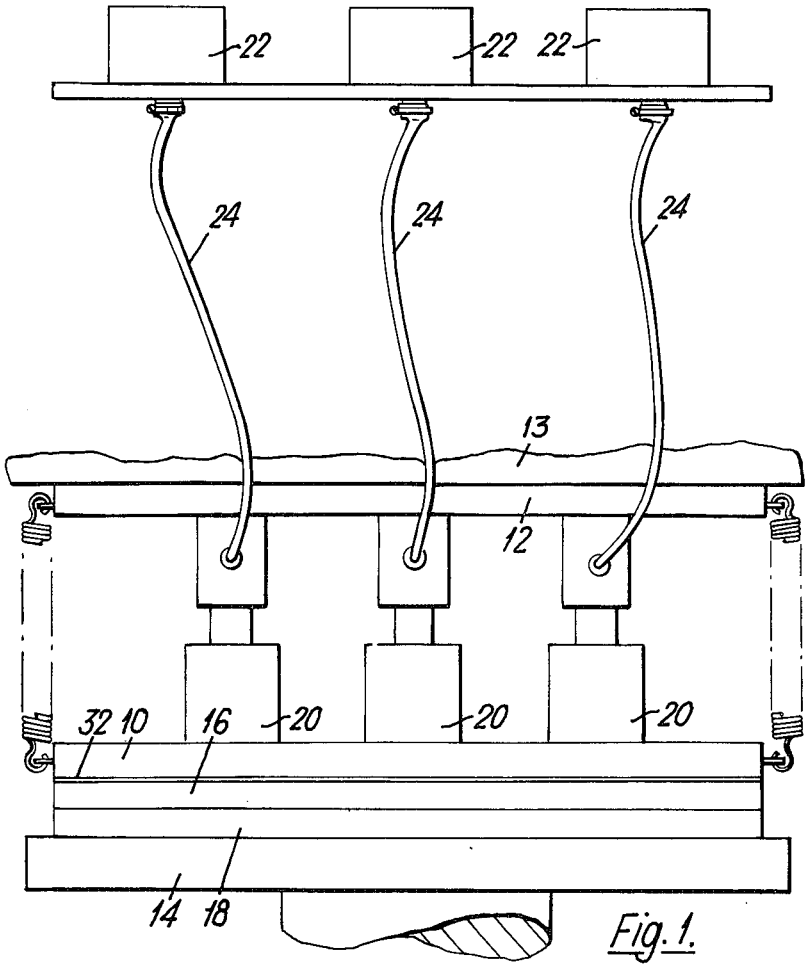
FIG. 1 is a schematic view of intaglio printing apparatus for use with the printing plates of this invention.

Referring to FIG. 1, an upper intaglio plate or die 10 for printing a pattern is supported from an upper support plate 13 mounted on an upper press platen 13. The press platen 12 cooperates with a lower press platen 14 which in turn supports a lower or bottom intaglio plate 16 and a manifold member 18. The sheet to be printed is placed between the plates 10 and 14. In the specification, the material to be printed will be described as a sheet of paper but it will be understood that the invention is applicable to any material to be printed with a design whether or not in sheet form or of paper. For example it may be a gasket to be printed with a sealing compound.

In the apparatus of FIG. 1, paint, sealing compound, or other printing fluid to be printed, is injected through the printing plate 10 by a plurality of injector units 20, three such units being illustrated in the drawings for printing three different colours or types of compound if desired alternatively each may print a similar compound. Each injector unit supplies printing fluid to one intaglio recess in the face of the plate.

The injector units 20 are each supplied from a corresponding printing fluid reservoir 22. Each injector unit 20 is connected to a corresponding one of the reservoirs 22 by a flexible conduit 24 which conducts printing fluid from the reservoir to the inlet of the injector. While the reservoirs 22 may be under pressure, preferably the feed from the reservoirs 22 is a gravity feed.

The injector units may each comprise a piston which works as a pump so that when the platens 13 and 14 are moved together printing material in the injector is forced against and through the die plate 10.

Figure 2:
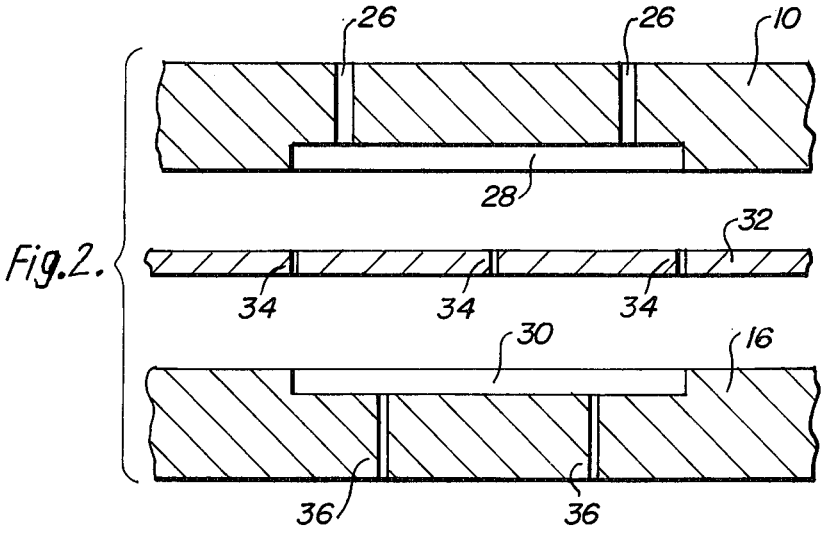
FIG. 2 is an exploded cross-sectional view of an intaglio die plate in accordance with the invention.

Referring to FIG. 2 the intaglio printing plate 10 is formed with passages 26 (only two of which are shown for clarity) passing through its thickness and communicating with a recessed design 28. The injector or pump units 20 are connected to the passages to force the material to be printed through the plate into the recess.

The intaglio printing plate 14 which is similar to the plate 10 is connected to the lower platen of the printing press and the recessed design 30 is a mirror image of the design 28 of the upper plate 10, the plates 10 and 16 being aligned.

The sheet material e.g. gasket material, to be printed is illustrated at 32 and is formed with a number of feed holes 34 passing through it.

On operation of the press sealant material is fed through the holes 26 into the recess 28 of the top plate and the top surface of the gasket 32 is printed with sealant material at those places where an additional height of sealant is required, sealant material then passes through the feed holes 34 and into the recessed design 30 of the lower printing plate 16. The bottom surface of the gasket 32 is thus also printed with sealant in the same operation.

The air from the recesses in the two plates and in the feed holes 26 and 34 bleeds out through the lower plate 16 through air bleed holes 36.

Figure 3:
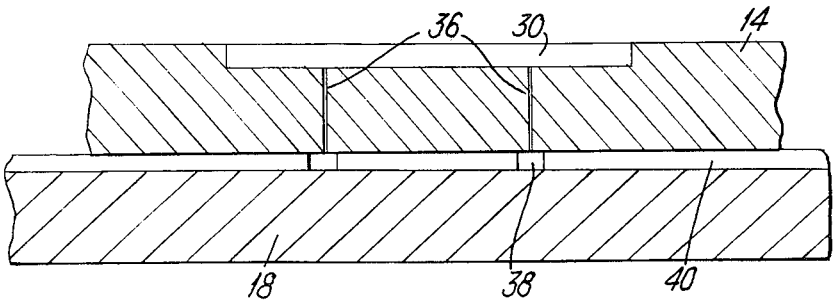
FIG. 3 is a cross-sectional view of the "bottom" printing plate of the invention attached to one embodiment of bleed air flow control device.
Figure 4:
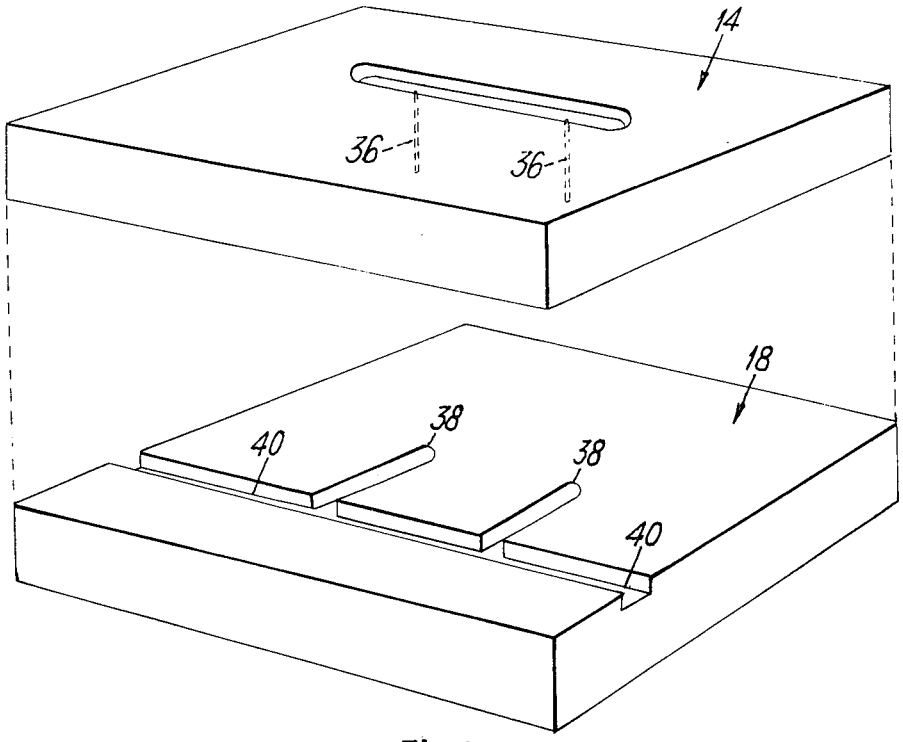
FIG. 4 is an exploded perspective view corresponding to FIG. 3.

These bleed holes have a diameter of between 0.040 inch and 0.005 inch preferably 0.020 inch so as to restrict the air flow whilst providing a reasonable exit passage. The holes communicate with passages 38 in the manifold plate 18, the passages 38 leading to main exit passage 40 which is open to atmosphere at each side of the plate (see FIGS. 3 and 4). This arrangement provides restriction to flow through the holes 36 but the passages 38, 40 are of sufficient size to allow unrestricted flow of excess printing fluid and entrapped air. The material of the plate 18 should be incompressible, dimensionally stable and resistant to the fluid to be printed. Steel and Tufnol have been found to be suitable.

We claim:

1. A method of simultaneously printing both sides of a gasket having feed holes therethrough with a sealant material comprising providing a generally planar, impervious gasket having two major surfaces and having feed holes therethrough of sufficient size to allow flow therethrough of a sealant material under pressure but to prevent flow therethrough when said sealant material is only under the force of gravity, locating said impervious gasket between upper and lower printing intaglio plates with recesses in the plates facing said two major surfaces, moving the upper intaglio printing plate toward the gasket and toward the lower intaglio printing plate to initiate a printing stroke, contacting said major surfaces of the gasket with said upper and lower printing plates with the recesses facing the gasket to create an enclosure of the recesses of said printing plates with the feed holes of said gasket providing fluid communication between the recesses, forcing the sealant material to be printed through the upper intaglio printing plate from a piston pump injector unit into the recessed design facing the gasket, through the feed holes in the gasket, to the recess in said lower intaglio printing plate located on the other side of the gasket from the upper intaglio plate, bleeding the air in said recesses out from the plates as said recesses are filled with the sealant material to be printed, passing the air being bled out of the recesses through air bleed holes in said lower intaglio printing plate, moving the upper intaglio printing plate away from the printed gasket to complete the printing stroke, removing the printed gasket from between said intaglio printing plates, and preventing sealant material from flowing through the feed holes in the gasket under gravity by said size of the feed holes in the gasket.

2. A method as claimed in claim 1 wherein the recess in said upper intaglio printing plate is a mirror image of the recess in said lower intaglio printing plate.

3. A method as claimed in claim 1 wherein the bleed holes have a diameter between 0.040 inch and 0.005 inch .

4. A method as claimed in claim 3 wherein the diameter of the air bleed holes is 0.020 inch .

5. A method as claimed in claim 3 wherein a manifold member is provided having the form of a plate for attachment to said lower intaglio printing plate, the member being formed with passages to communicate both with the air bleed holes and with the atmosphere.

* * * * *